US007244700B2

(12) United States Patent
McKechnie

(10) Patent No.: US 7,244,700 B2
(45) Date of Patent: Jul. 17, 2007

(54) CLEANING COMPOSITIONS CONTAINING CHITOSAN SALT

(75) Inventor: Malcolm Tom McKechnie, Driffield (GB)

(73) Assignee: Reckitt Benckiser (UK) Limited, Slough, Berkshire (GB)

( * ) Notice: Subject to any disclaimer, the term of this patent is extended or adjusted under 35 U.S.C. 154(b) by 0 days.

(21) Appl. No.: 10/398,143

(22) PCT Filed: Oct. 4, 2001

(86) PCT No.: PCT/GB01/04417

§ 371 (c)(1),
(2), (4) Date: May 23, 2003

(87) PCT Pub. No.: WO02/28990

PCT Pub. Date: Apr. 11, 2002

(65) Prior Publication Data

US 2003/0176306 A1 Sep. 18, 2003

(51) Int. Cl.
*C11D 3/395* (2006.01)
*C11D 3/384* (2006.01)

(52) U.S. Cl. ..... 510/379; 510/191; 510/199; 510/238; 510/243; 510/367; 510/380; 510/381; 510/427; 510/463; 510/462

(58) Field of Classification Search ..... 510/370, 510/379, 380, 382, 461, 462, 470, 191, 199, 510/238, 243, 367, 381, 427, 463
See application file for complete search history.

(56) References Cited

U.S. PATENT DOCUMENTS

| | | | | |
|---|---|---|---|---|
| 5,281,280 | A | 1/1994 | Lisowski et al. | |
| 5,741,783 | A | 4/1998 | Haase et al. | |
| 5,777,091 | A | 7/1998 | Kuhn et al. | |
| 5,981,718 | A * | 11/1999 | Olsen et al. | 530/402 |
| 6,204,235 | B1 * | 3/2001 | Jimenez Carrillo et al. | 510/379 |
| 6,352,727 | B1 * | 3/2002 | Takahashi | 424/742 |
| 6,362,142 | B1 | 3/2002 | Weber et al. | 510/119 |
| 6,395,701 | B1 * | 5/2002 | Connor et al. | 510/437 |
| 6,524,624 | B1 * | 2/2003 | Morelli et al. | 424/665 |
| 6,562,802 | B2 * | 5/2003 | Johansson et al. | 514/55 |
| 6,602,845 | B2 * | 8/2003 | Connor et al. | 510/437 |
| 2003/0211963 | A1 * | 11/2003 | Bettiol et al. | 510/499 |

FOREIGN PATENT DOCUMENTS

| | | | |
|---|---|---|---|
| CN | 1218504 | | 6/1999 |
| CN | 1266922 | | 9/2000 |
| DE | 197 30 649 | C | 9/1998 |
| EP | 0 903 402 | A | 3/1999 |
| EP | 0 903402 | A1 | 3/1999 |
| GB | 2311996 | | 10/1997 |
| JP | 05 059215 | A | 3/1993 |
| JP | 0803 10943 | A | 11/1996 |
| JP | 8310943 | A | 11/1996 |
| JP | 2000 230 153 | A | 8/2000 |
| JP | 2000 230153 | | 8/2000 |
| WO | 00/60038 | | 10/2000 |
| WO | WO 00/60038 | A1 | 10/2000 |

OTHER PUBLICATIONS

PCT International Search Report, dated Dec. 21, 2001 for PCT/GB01/04417.
GB Search Report dated Apr. 5, 2001, for GB 0024489.7.
GB Search Report dated Feb. 19, 2002 for GB 0123812.0.
Derwent Publications Ltd. Abstract, Access No. 1993-121503 Mar. 9, 1993 XP002186399.
WPI Abstract Access No. 2000-641571 for JP 2000 230153 A.
WPI Abstract Access No. 1997-0619718 for JP 080310943 A.
Abstract of EP 0903402 from EPO website database.

* cited by examiner

*Primary Examiner*—Charles Boyer
(74) *Attorney, Agent, or Firm*—Norris McLaughlin & Marcus, PA

(57) ABSTRACT

An aqueous cleaning composition for the removal of mould and mildew is provided. The composition includes a water soluble source of chlorine, a surfactant, chitosan and water and has improved anti-fungal activity.

15 Claims, No Drawings

CLEANING COMPOSITIONS CONTAINING CHITOSAN SALT

The present invention relates to aqueous cleaning compositions. In particular, the present invention relates to aqueous cleaning compositions for the removal of mould and mildew.

Aqueous cleaning compositions for the removal of mould and mildew from a surface are well known and popular with consumers. Typically the compositions are used to clean hard surfaces such as ceramics, tiles and/or glass in damp and/or humid environments such as bathrooms and kitchens. Such compositions may also be used in toilet bowls and/or bidets.

A need exists, however, for the cleaning compositions to impart residual anti-fungal activity to a surface cleaned with the composition.

According to a first aspect to the present invention there is provided an aqueous cleaning composition comprising a source of chlorine, a surfactant, chitosan, and water.

Suitably the composition is effective in combating mould and mildew on a surface. By combating, we include the prevention of mould and mildew on a surface, and the removal of mould and mildew from the surface.

It has surprisingly been found that the addition of chitosan to such cleaning compositions leads to an increase in the residual anti-fungal activity of the cleaning composition.

The source of chlorine may be water soluble and is preferably a hypochlorite salt, most preferably an alkali metal hypochlorite salt, for example, sodium hypochlorite. It will be appreciated, however, that other sources of chlorine, such as precursors of chlorites and chlorites themselves may also be used. Such compounds include chlorine dioxide with sodium chlorite as the precursor thereof. Other sources of chlorine also include alkali metal salts of diisochlorocyanurate, for example, sodium diisochlorocyanurate.

Preferably the source of chlorine is present in amount of from 1 to 10% chlorine by weight, more preferably 1.5 to 5% chlorine by weight. Thus, sodium hypochlorite (15% chlorine by weight) may be present in solution from 10 to 33.33% by weight in total to yield 1.5 to 5% by weight chlorine in the final solution.

The surfactant present may be nonionic, anionic, cationic or zwitterionic.

Nonionic surfactants may be alcohol ethoxylates, and/or alkyl phenol ethoxylates.

Anionic surfactants may be alkali metal salts of alkyl sulphates, alkyl benzene sulphates, and/or alkyl ether sulphates.

Cationic surfactants may be quaternary ammonium compounds such as benzalkonium chlorides, cetyl trimethlyammonium chloride and/or bromide.

Zwitterionic surfactants may be alkyl betaines, sulpho betaines and/or coco dimethyl betaines.

Some surfactants, such as amine oxides, are nonionic at and above pH 7 but cationic below pH 7. Such surfactants may also be used in the present invention.

The choice of anionic surfactants will be limited as the chitosan is positively charged and can form insoluble complexes with anionic surfactants.

In a preferred embodiment of the present invention the surfactant is a nonionic surfactant, most preferably lauryl dimethylamine oxide.

The surfactant is preferably present in an amount of 0.05 to 5%, most preferably 0.1 to 3% by weight of the total composition.

Chitosan is a high molecular weight cationic polysaccharide derived from crustacean shells by deacetylation of naturally occurring chitin.

The chitosan used is preferably a chitosan salt, for example chitosan glutamate or chitosan chloride. Most preferably chitosan chloride is used.

As such, the chitosan salt may be present in the composition in an amount of from 0.001 to 1.0% by weight, preferably 0.005 to 0.5% by weight of the total composition.

Chitosan forms a soft translucent gel when combined with a source of chlorine, for example, sodium hypochlorite. Without being bound by theory, the applicant is of the view that in the compositions of the present invention, an active gel residue remains on the surface cleaned with the compositions thereby providing residual anti-fungal activity.

The cleaning compositions according to the present invention may include pH adjusting agents, for example, sodium hydroxide and/or buffering solutions to adjust and/or stabilise the pH of the composition. Preferably, the pH of the composition is basic, that is to say between 7 and 14, more preferably between 9 and 14, most preferably 11 to 14.

The compositions according to the present invention may also include further conventional excipients such as fragrances, dyes and the like. Such excipients are preferably present in an amount of 0.01 to 5% by weight of the total composition.

Preferably the surface cleaned is a hard surface, most preferably a non-porous, hard surface, for example, glass, ceramic or plastic.

According to a further aspect to the present invention there is provided the use of chitosan to impart residual anti-fungal activity to an aqueous cleaning composition, said use comprising including in the composition an effective amount of chitosan. Suitably the composition is as defined above.

The invention will now be further described with reference to the following examples:

EXAMPLE 1

The following aqueous cleaning solutions were made up as follows:

TABLE 1

| | Anti-fungal test compositions | | | | |
|---|---|---|---|---|---|
| | % by weight | | | | |
| Ingredient | Control | Test 1 (50 ppm) | Test 2 (100 ppm) | Test 3 (500 ppm) | Test 4 (1000 ppm) |
| Sodium hypochlorite (15% chlorine w/w) | 17.24 | 15.52 | 15.52 | 15.52 | 15.52 |
| Lauryl dimethyelamine oxide | 0.47 | 0.42 | 0.42 | 0.42 | 0.42 |
| Fragrance (Que Mildred) F538.98 6 | 0.09 | 0.08 | 0.08 | 0.08 | 0.08 |
| Sodium Hydroxide | 0.20 | 0.18 | 0.18 | 0.18 | 0.18 |
| Chitosan Seacure Cl110 | — | 0.005 | 0.01 | 0.05 | 0.1 |
| Water | 82.20 | 83.79 | 83.79 | 83.75 | 83.7 |

EXAMPLE 2

Each of the solutions of Example 1 were tested using MIC233 'Determination of residual fungistatic activity on non-porous surfaces following multiple application of test product'. Tex reference 21325 version 1.

The test is conducted by treating glass slides, wiping and reapplying the test treatment up to the required number of applications being examined. This is an attempt to simulate the likely in-use situation. Treated surfaces are dried, and then inoculated with an innoculum-nutrient solution, redried and incubated for four weeks. The effectiveness of treatment is determined by the presence/absence of visible fungal growth compared with the control.

| Sample | No. of Product Treatments | No. of slides (n = 10) showing growth of *Aspergillus niger* after 1 wk | 2 wk | 3 wk | 4 wk | 5 wk | 6 wk | 7 wk | 8 wk |
|---|---|---|---|---|---|---|---|---|---|
| Control | 1 | 7 | 10 | 10 | 10 | 10 | 10 | 10 | 10 |
| | 3 | 4 | 10 | 10 | 10 | 10 | 10 | 10 | 10 |
| | 5 | 3 | 10 | 10 | 10 | 10 | 10 | 10 | 10 |
| Test 1 | 1 | 0 | 0 | 0 | 0 | 0 | 0 | 0 | 0 |
| (50 ppm) | 3 | 0 | 0 | 0 | 0 | 0 | 0 | 0 | 0 |
| | 5 | 0 | 0 | 0 | 0 | 0 | 0 | 0 | 0 |
| Test 2 | 1 | 0 | 0 | 0 | 0 | 0 | 0 | 0 | 0 |
| (100 ppm) | 3 | 0 | 0 | 0 | 0 | 0 | 0 | 0 | 0 |
| | 5 | 0 | 0 | 0 | 0 | 0 | 0 | 0 | 0 |
| Test 3 | 1 | 0 | 0 | 0 | 0 | 0 | 0 | 0 | 0 |
| (500 ppm) | 3 | 0 | 0 | 0 | 0 | 0 | 0 | 0 | 0 |
| | 5 | 0 | 0 | 0 | 0 | 0 | 0 | 0 | 0 |
| Test 3 | 1 | 0 | 0 | 0 | 0 | 0 | 0 | 0 | 0 |
| (1000 ppm) | 3 | 0 | 0 | 0 | 0 | 0 | 0 | 0 | 0 |
| | 5 | 0 | 0 | 0 | 0 | 0 | 0 | 0 | 0 |

The above data shows an increase in the residual antifungal activity of aqueous mould and mildew cleaning compositions with the addition of chitosan. In this study, it was shown that after 1, 3 and 5 applications of product, as little as 10 ppm chitosan would inhibit the growth of *A. niger* spores for up to eight weeks.

The invention claimed is:

1. A method of cleaning a hard surface comprising:

applying an aqueous cleaning. composition to the hard surface, wherein the composition comprises:

a) a source of water soluble chlorine selected from the group consisting of alkali metal hypochlorites, precursors of chlorites, chlorites, and alkali metal salts of diisochlorocyanurate;

b) a surfactant;

c) from 0.001 to 1.0% of a chitosan salt; and d) water characterized in that the chitosan salt forms a gel when combined with the source of chlorine, and said gel is present on the hard surface to which the aqueous cleaning composition is applied.

2. A method as claimed in claim 1, wherein the source of chlorine is sodium hypochiorite.

3. A method as claimed in claim 1, wherein the source of chlorine is present in an amount of 1 to 10% chlorine by weight of the total composition.

4. A method as claimed in claim 1, wherein the surfactant is selected from nonionic surfactants, anionic surfactants, cationic surfactants, and zwitterionic surfactants.

5. A method as claimed in claim 4, wherein the nonionic surfactants arc alcohol ethoxylates or alkyl phenol ethoxylates.

6. A method as claimed in claim 4, wherein the anionic surfactants are selected from the group consisting of alkali metal salts of alkyl sulphates, alkyl benzene sulphates and alkyl ether sulphates.

7. A method as claimed in claim 4, wherein the cationic surfactants arc quaternary ammonium compounds.

8. A method as claimed in claim 7, wherein the quaternary ammonium compounds are selected from the group consisting of benzalkonium chlorides, cetyl trimethylammonium chloride and cetyl trimethylammonium bromide.

9. A method as claimed in claim 4, wherein the zwitterionic surfactants arc selected from the group consisting of alkyl betaines, sulpho betaines and/or coco dimethyl betaines.

10. A method as claimed in claim 4 including a nonionic surfactant in the form of lauryl dimethylamine oxide.

11. A method as claimed in claim 4, wherein the surfactant is present in an amount of 0.05 to 5% by weight of the total composition.

12. A method as claimed in claim 1, wherein the salt is chitosan glucamate or chitosan chloride.

13. A method as claimed in claim 1 further comprising additional excipients selected from Fragrances, dyes, pH adjusting agents and buffering solutions.

14. An aqueous hard surface cleaning composition comprising:

a) a source of water soluble chlorine selected from the group consisting of alkali metal hypochlorites, precursors of chlorites, chlorites, and alkali metal salts of diisochlorocyanurate;

b) a surfactant;

c) from 0.001 to 1.0% of a chitosan salt; and d) water characterized in that the chitosan salt forms a gel when combined with the source of chlorine, and said gel is present on the hard surface to which the aqueous hard surface cleaning composition is applied.

15. An aqueous hard surface cleaning composition according to claim 14 wherein the salt is chitosan glucarnate or chitosan chloride.

* * * * *